US008931673B2

(12) United States Patent
Stevens, IV

(10) Patent No.: US 8,931,673 B2
(45) Date of Patent: Jan. 13, 2015

(54) ERGONOMIC REVERSIBLE ATTACHMENT DEVICE FOR A LOAD-CARRYING SYSTEM

(76) Inventor: Nathaniel D. Stevens, IV, Wildomar, CA (US)

( * ) Notice: Subject to any disclaimer, the term of this patent is extended or adjusted under 35 U.S.C. 154(b) by 1065 days.

(21) Appl. No.: 12/249,738

(22) Filed: Oct. 10, 2008

(65) Prior Publication Data

US 2012/0181311 A1 Jul. 19, 2012

(51) Int. Cl.

| | |
|---|---|
| ***A45C 1/04*** | (2006.01) |
| ***A45F 3/00*** | (2006.01) |
| ***F41C 33/02*** | (2006.01) |
| ***F42B 39/02*** | (2006.01) |
| ***A41F 9/00*** | (2006.01) |
| ***A45F 5/02*** | (2006.01) |

(52) U.S. Cl.

CPC . *A41F 9/002* (2013.01); *A45F 5/02* (2013.01); *A45F 5/021* (2013.01)

USPC ..... 224/675; 224/671; 224/672; 224/674

(58) Field of Classification Search

CPC ..... A45F 5/02; A45F 5/021

USPC ..... 224/675, 671, 672, 674

See application file for complete search history.

(56) References Cited

U.S. PATENT DOCUMENTS

| | | | | |
|---|---|---|---|---|
| 3,664,560 | A * | 5/1972 | Perkins | 224/677 |
| 4,174,793 | A * | 11/1979 | Wisowaty | 224/240 |
| 4,386,723 | A | 6/1983 | Mule | |
| 4,907,729 | A * | 3/1990 | Hess, III | 224/682 |
| 4,957,231 | A * | 9/1990 | Kalisher | 224/583 |
| 5,018,654 | A | 5/1991 | Rogers et al. | |
| 5,100,036 | A | 3/1992 | Rogers et al. | |
| 5,127,566 | A | 7/1992 | Beletsky | |
| 5,275,317 | A | 1/1994 | Rogers et al. | |
| 5,464,136 | A | 11/1995 | Eddy | |
| 5,526,924 | A * | 6/1996 | Klutznick | 206/5 |
| 5,558,440 | A * | 9/1996 | Miller | 383/87 |
| 5,683,022 | A * | 11/1997 | Evans | 224/583 |
| 5,839,630 | A * | 11/1998 | Dunstan et al. | 224/197 |
| 5,964,386 | A | 10/1999 | Cote | |
| 6,168,057 | B1 * | 1/2001 | Schwabe | 224/269 |
| 6,691,906 | B2 * | 2/2004 | Cragg | 224/238 |
| 6,913,176 | B1 * | 7/2005 | Buscemi | 224/665 |

(Continued)

FOREIGN PATENT DOCUMENTS

WO WO 2006-134241 A1 12/2006

*Primary Examiner* — Brian D Nash
*Assistant Examiner* — Derek Battisti
(74) *Attorney, Agent, or Firm* — GSS Law Group

(57) ABSTRACT

A reversible attachment device comprises a reversible hanger having a piece of hook material on a first side and a piece of loop material on a second side and may optionally be assembled with either side facing an accessory holder. Embodiments of a reversible attachment stabilize and distribute loads from objects in accessory holders. By selecting which side of the reversible hanger faces the accessory adapter, an accessory holder may be suspended from a load-carrying structure having either loop material or hook material. In some embodiments, the hook material and loop material are formed into a sleeve which fits slidably around the reversible hanger. Alternative assembly configurations for an embodiment provide for a range of height adjustment between an accessory holder and a load-carrying structure. Some embodiments include an accessory holder with a reversible attachment device. Other embodiments include a duty belt or other load-carrying structure.

19 Claims, 11 Drawing Sheets

(56) References Cited

U.S. PATENT DOCUMENTS

| | | | | |
|---|---|---|---|---|
| 7,065,842 | B2 | 6/2006 | Haglof | |
| 7,770,770 | B2 * | 8/2010 | Murdoch et al. | 224/672 |
| 2003/0110550 | A1 | 6/2003 | Guibord | |
| 2005/0279786 | A1 | 12/2005 | Gac | |
| 2006/0237509 | A1 * | 10/2006 | Moore | 224/675 |
| 2007/0045364 | A1 | 3/2007 | Grundy | |
| 2007/0215657 | A1 * | 9/2007 | Stewart | 224/197 |
| 2008/0041897 | A1 | 2/2008 | Malhotra | |

* cited by examiner

PRIOR ART

PRIOR ART

ERGONOMIC REVERSIBLE ATTACHMENT DEVICE FOR A LOAD-CARRYING SYSTEM

FIELD OF THE INVENTION

The present invention is generally directed to a device for attaching a carrying case or equipment holder to a load-carrying system comprising a belt, sling, or strap.

BACKGROUND

Load-carrying systems for safely and securely carrying equipment and supplies are frequently used by military, law enforcement, public safety, and security personnel. For example, a load-carrying system known as Modular Lightweight Load-carrying Equipment, more commonly referred to as the MOLLE system, is used by military personnel for carrying weapons, ammunition, communication equipment, first aid supplies, and other items. The MOLLE system includes an assortment of cases and holders which may be attached to nylon straps known as a Pouch Attachment Ladder System, also referred to as a PALS grid. A PALS grid may be affixed to a load-carrying structure such as a protective vest, jacket, helmet, backpack, or part of a vehicle. Selected holsters, holders, clips, hangers, cases, and carriers, referred to herein as accessory holders, may be attached to straps in a PALS grid or to a compatible duty belt or chest harness worn by a person. Public safety personnel may wear a similar load-carrying system, for example a duty belt or a protective vest to which accessory holders for equipment such as a sidearm, flashlight, radio, handcuffs, chemical deterrent, cellular telephone, keys, and so on, may be attached.

A load-carrying system as referred to herein comprises a load-carrying structure optionally having affixed to it one or more pieces of hook-and-loop material. The hook-and-loop material improves retention of accessory holders supported by the load carrying system and opposes sliding of the accessory holders along the load-carrying structure, while allowing the accessory holders to be removed or repositioned. The hook-and-loop material, also known as thistle cloth, includes two complementary parts, a hook part and a loop part, each part formed into a strip or patch of synthetic fabric. The hook part, referred to herein as hook material, and the loop part, referred to herein as loop material, readily adhere to each other to form a mechanical connection, yet the two complementary parts may be separated relatively easily by peeling them apart. A product having the trademarked name "Velcro" by Velcro Industries B.V. is an example of a hook-and-loop material.

A load-carrying system further comprises one or more accessory holders. An accessory holder compatible with the load-carrying system includes a piece of hook-and-loop material complementary to the piece of hook-and-loop material attached to the load-carrying structure. Examples of load-carrying structures for load-carrying systems known in the art are shown in FIG. 1, FIG. 2, FIG. 3, and FIG. 4. FIG. 1 shows an example of a duty belt known in the art. The duty belt 100 of FIG. 1 comprises a strip of hook material 102 on an inside surface of the duty belt 100. The hook material 102 is identified in FIG. 1 and other figures referenced herein by a pattern of "+" symbols on a contact surface for the complementary loop material. FIG. 2 shows another example of a duty belt known in the art, comprising a strip of loop material 106 on an inside surface of the duty belt 104. The loop material 106 is identified in FIG. 2 and other figures referenced herein by a stippling pattern on a contact surface for the complementary hook material.

Another example of a load-carrying structure known in the art is shown in FIG. 3. The load-carrying structure of FIG. 3 comprises a duty belt 100 as in FIG. 1. The load-carrying structure further comprises a liner belt 108 which provides additional support for equipment attached to the duty belt and may optionally include padding for the comfort of a person wearing the belt. The liner belt 108 and the duty belt 100 of FIG. 3 attach to each other as shown in the cross-sectional view of FIG. 4. A location and viewing direction for the cross-section of FIG. 4 is shown by a line marked A-A in FIG. 3. Referring to FIG. 4, a duty belt 100 having a piece of hook material 102 attached to an inner surface of the duty belt is removably attached to a liner belt 108 having a complementary piece of loop material 106 attached to an outer surface of the liner belt. In similar fashion, a liner belt having a piece of hook material on an outer surface may be combined with a duty belt having a piece of loop material on an inner surface, for example the duty belt of FIG. 2.

An accessory holder adapted for use with a load-carrying system known in the art, such as one of the duty belts of FIGS. 1-4, is shown in the prior-art illustrations of FIG. 5 and FIG. 6. FIG. 5 shows a front view of an accessory holder 110 having a cover flap secured with a snap. FIG. 6 shows a side view of the accessory holder 110 of FIG. 5. A belt loop 112 is attached to a rear surface of the accessory holder by stitching, fusing, adhesive, threaded fasteners, rivets, or similar strong attachment means. An end of the belt loop 112 is held closed by one or more pairs of threaded fasteners 116. Removing one member of each pair of threaded fasteners allows the belt loop to be opened and placed around a belt, strap, sling, or similar load-carrying structure. The threaded fasteners are reattached to close the belt loop after the accessory holder 110 is placed at a selected location on the load-carrying structure. Alternately, an end of a belt or strap may be inserted through the opening in the belt loop 112 without disconnecting the threaded fasteners.

A piece of one of the complementary parts 114 of hook-and-loop fastener material is attached to an inner surface of the belt loop 112, as shown in FIG. 6. For an accessory holder 110 intended for attachment to a load-carrying structure comprising hook material, as in the example of a duty belt shown in FIG. 1, the complementary part 114 of the hook-and-loop fastener material on the belt loop 112 is the loop material. For an accessory holder 110 intended for attachment to a load-carrying structure comprising loop material, as in the example of a duty belt shown in FIG. 2, the complementary part 114 of the hook-and-loop fastener on the belt loop 112 is the hook material.

A force of adhesion between a piece of hook material and a complementary piece of loop material is related in part to an amount of contact area between the two pieces. Furthermore, hook-and-loop materials are available with different amounts of adhesion strength per unit of area. A strength of attachment between a load-carrying structure and an accessory holder may therefore be selected for a size, weight, carrying location, and amount of removal force needed for a particular equipment item by selecting a size of a contact area and an adhesion strength per unit of area between complementary parts of the hook-and-loop material used in a load-carrying system.

Because pieces of hook-and-loop fastener material must be complementary to adhere to each other, an accessory holder having only loop material will not adhere to a load-carrying structure having only loop material. Similarly, an accessory holder having only hook material will not adhere to a load-carrying structure having only hook material. For example, a prior-art accessory holder for use with the prior-art duty belt example of FIG. 1 will not be properly retained by a prior-art duty belt like the one shown in FIG. 2, and a prior-art accessory holder for use with the prior-art duty belt of FIG. 2 will not be retained properly on the prior-art duty belt of FIG. 1. Similar incompatibilities occur with other load-carrying systems known in the art. In general, accessory holders having hook material for attaching to a load-carrying structure are incompatible with load-carrying structures having hook material for attaching accessory holders, and accessory holders having loop material for attaching to a load-carrying structure are incompatible with load-carrying structures having loop material for attaching accessory holders.

An accessory holder compatible with a load-carrying system from one supplier may not be available with hook-and-loop material compatible with a different load-carrying system from another supplier. Furthermore, incompatibility between accessory holders and load-carrying systems may cause problems in logistics, interchangeability of equipment, interchangeability of load-carrying system components, positioning of accessory holders on a load-carrying system, movement of an accessory holder away from a selected position on a load-carrying system, procurement, training, maintenance, and other problems. What is needed is a device that enables an accessory holder to be attached to a load-carrying structure comprising either hook material or loop material. What is further needed is a device that may be retrofitted to an accessory holder already in the possession of a person using a load-carrying system.

SUMMARY

A reversible attachment device in accord with an embodiment of the invention enables an accessory holder to be removably attached to a load-carrying structure comprising a belt, strap, band, or sling and one of the complementary parts of hook-and-loop fastener material. Embodiments of the reversible attachment device include a reversible hanger having hook material on a first side for attachment to load-carrying structures having loop material on a surface for attachment of accessory holders. A second side of the reversible hanger includes loop material for attachment to load carrying structures having hook material on a surface for attachment of accessory holders. The reversible hanger may optionally be assembled to an object to be suspended from a load-carrying structure with the side of the reversible hanger having hook material facing the object, thereby enabling attachment of a reversible attachment device to a load-carrying structure comprising loop material. Alternately, the reversible hanger may be assembled to the object with the side of the reversible hanger having loop material facing the object, thereby enabling attachment of the reversible attachment device to a load-carrying structure comprising hook material.

Some embodiments of a reversible attachment device include an accessory adapter assembled to the reversible hanger. An accessory adapter is a support structure for attaching to one or more kinds of accessory holder, thereby enabling replacement of an accessory holder and further enabling attachment of an accessory holder provided separately from the embodiment by a user of the reversible attachment device. In other embodiments, an accessory adapter may alternately be permanently attached to an accessory holder or be formed as an integral part of an accessory holder. In some embodiments, an accessory holder and an accessory adapter are joined by a rotator plate to enable placement of an accessory holder at a selected angle relative to a load-carrying structure.

Some embodiments comprise a reversible attachment device combined with an accessory holder. Other embodiments comprise a reversible attachment device combined with a load-carrying structure, for example a duty belt, a chest sling, or an article of equipment having a PALS grid, such as a protective vest or a backpack. Yet other embodiments comprise a reversible attachment device combined with an accessory holder and a load-carrying structure.

This section summarizes some features of embodiments of the invention. These and other features, aspects, and advantages of embodiments of the invention will become better understood with regard to the following description and upon reference to the following drawings, wherein:

BRIEF DESCRIPTION OF THE DRAWINGS

FIG. 12 further illustrates an embodiment of a reversible attachment device configured for attachment to a load-carrying structure comprising loop material.

FIG. 15 further illustrates an embodiment of a reversible attachment device configured for attachment to a load-carrying structure comprising loop material.

DESCRIPTION

Figure 1:
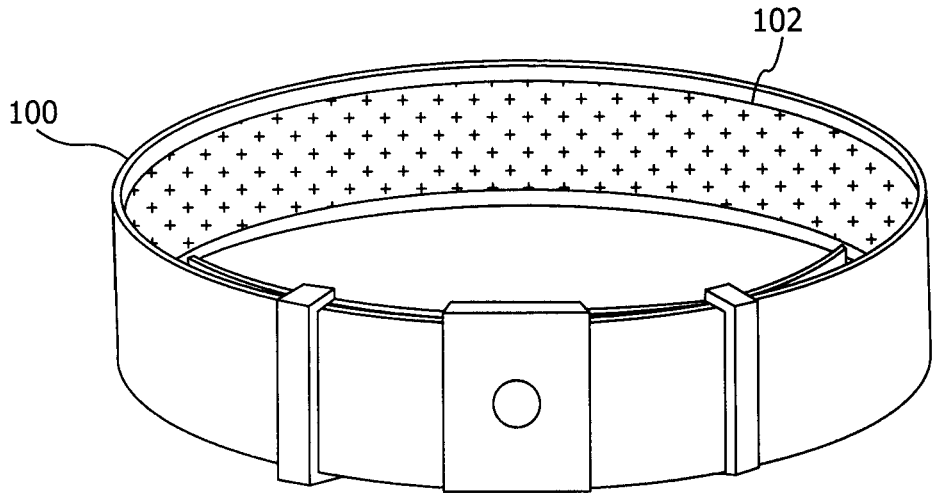
Fig. 1 PRIOR ART
FIG. 1 is a pictorial view of an example of a load-carrying structure comprising a duty belt having a band of hook material on an inside surface of the belt. (PRIOR ART)

Embodiments of the invention comprise a reversible attachment device for removably attaching an accessory holder to a load-carrying structure. Embodiments of the reversible attachment device comprise a reversible hanger having a piece of hook material on a first side and a piece of loop material on a second side. By selecting which side of the reversible hanger engages with a load-carrying structure, the reversible attachment device enables attachment of an accessory holder to a load-carrying structure comprising either hook material or loop material.

Preferred load-carrying structures for use with an embodiment of the invention have one or more pieces of one of the complementary parts of hook-and-loop material, that is, hook material or loop material, attached to part of the load-carrying structure. Load-carrying structures include, but are not limited to, a duty belt, a chest sling, a PALS grid attached to an article of clothing such as a helmet or a vest, a PALS grid attached to a piece of equipment such as a backpack a vehicle, or other slings, straps, or bands, any of which may optionally be substituted in examples of load-carrying structures described herein. Some embodiments comprise a reversible attachment device in combination with a load carrying structure. A load-carrying structure included with an embodiment may optionally be MOLLE compatible.

The tendency for complementary pieces of hook-and-loop material to adhere strongly to each other enables an accessory holder attached to an embodiment of a reversible attachment device to remain in a selected position on a load-carrying structure that also has hook-and-loop material. However, embodiments of the invention provide useful benefits even when suspended from a load-carrying structure that does not include hook-and-loop material. For example, a liner belt having hook-and-loop material may be added to a duty belt lacking hook-and-loop material by suspending from the duty belt two or more accessory holders with reversible attachment devices. The liner belt is then attached to and supported from the hook-and-loop material on the reversible attachment devices. A liner belt increases comfort for the wearer and an accessory holder is less subject to slipping along a duty belt lacking hook-and-loop material when combined with a reversible attachment device and a liner belt.

Accessory holders suitable for use with an embodiment of the invention include, but are not limited to, holsters, handcuff cases, ammunition cases (also known as "double mag pouches"), chemical spray holders (also known as OC holders), and clips, rings, pouches, and holders for radios, electroshock devices, batons, cellular telephones, breathing equipment, protective or corrective eyewear, and so on. Other examples of accessory holders suitable for use with an embodiment include tool holsters such as a hammer holster, a pliers holder, and similar holders and holsters for hand tools and small measuring instruments such as continuity testers, voltmeters, and so on. Optional accessories such as, but not limited to, holster belt loops, holster belt drops, and holster comfort pads are also suitable for use with embodiments of the invention. Such optional accessories may be used in combination with or substituted for examples of accessory holders described herein. Furthermore, an accessory holder included with an embodiment of the invention may optionally be a MOLLE-compatible accessory holder. One will appreciate that accessory holders described herein are intended to be representative of a large variety of accessory holders that could alternatively be used with or included in an embodiment of the invention.

A reversible attachment device in accord with an embodiment of the invention include is effective for stabilizing an object carried in an accessory holder, especially during vigorous motion by a person wearing a reversible attachment device. Some advantages of embodiments of the invention include, but are not limited to, distribution of the weight of an object carried in or attached to a reversible attachment device, easy repositioning of accessory holder to improve access and comfort for a person wearing a reversible attachment device, and adjustable height of an accessory holder relative to a load carrying structure. Embodiments of the invention provide ergonomic benefits by reducing a number of repetitive motions by a person attempting to counterbalance a poorly positioned, long, or heavy object carried in an accessory holder, or repetitive motions to avoid repeated impacts, pressure, or even injury on a part of a person's body from a swinging or poorly positioned object carried in an accessory holder. Furthermore, a reversible attachment device brings many of these advantages and benefits to a load-carrying structure that does not have hook-and-loop fastener.

Figure 7:
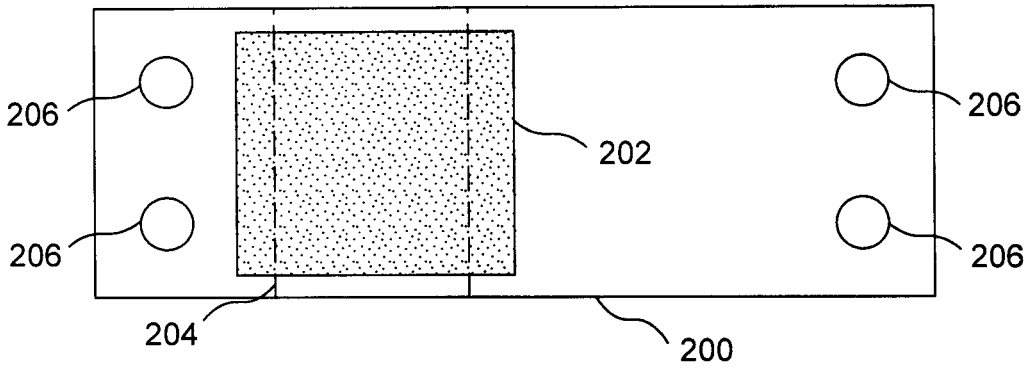
FIG. 7 is a front view of an embodiment of a reversible hanger showing a first side comprising a piece of loop material.
Figure 8:
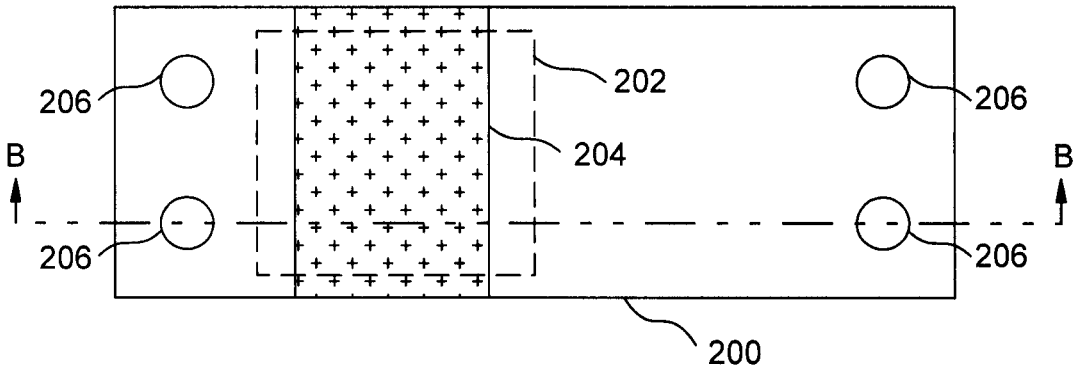
FIG. 8 is a back view of the reversible hanger of FIG. 7, showing a second side comprising a piece of hook material.

An example of a reversible attachment device comprising a reversible hanger is shown in FIG. 7 and FIG. 8. FIG. 7 illustrates an example of a reversible hanger 200 made from a flexible material, for example fabric, leather, synthetic leather, flexible plastic, or combinations of these materials, to which is attached on a first side a piece of loop material 202. A piece of hook material 204 is attached to a second side of the reversible hanger 200, as shown in FIG. 8. In a preferred embodiment, the loop material 202 and the hook material 204 are attached to the reversible hanger 200 by stitching, although adhesive, rivets, fusing, snaps, or other attachment means may optionally be used. A size and location of the loop material 202 and the hook material 204 are selected to align with complementary pieces of hook-and-loop material on selected load-carrying structures. A plurality of through-holes 206 formed in the reversible hanger 200 are provided for a clearance fit of threaded fasteners for attaching the reversible hanger 200 to an object to be suspended from a load-carrying structure.

Figure 9:
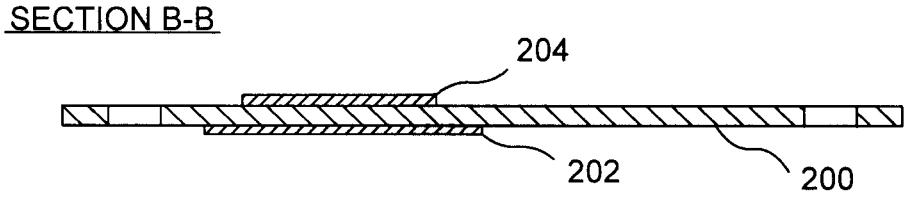
FIG. 9 is a cross sectional view of the reversible hanger of FIG. 7 and FIG. 8. A location and viewing direction for the cross section is shown by a line marked B-B in FIG. 8.

The reversible hanger 200 of FIG. 7 and FIG. 8 is relatively thin, as shown in the cross-sectional view of FIG. 9. The location and viewing direction for FIG. 9 is shown by a line marked B-B in FIG. 8. One will appreciate that many alternative embodiments of a reversible attachment device may be made by varying the size and shape of the reversible hanger 200, by changing the size and location of the loop material 202 or the hook material 204, by changing the size and location of through-holes 206, or by changing construction materials. Such alternative embodiments may be made to adapt a reversible attachment device to different load-carrying structures or accessory holders.

A reversible attachment device may optionally be attached directly to an accessory holder. Alternatively, a reversible attachment device optionally includes a support structure to which an accessory holder and a reversible hanger may both be attached. The support structure, referred to herein as an accessory adapter, is a relatively stiff component for adapting embodiments of a reversible attachment device to different accessory holders. In some embodiments, an accessory adapter increases the stiffness of an accessory adapter and helps distribute the weight of equipment in the accessory holder evenly across a segment of the load-carrying structure. Furthermore, a reversible attachment device including an accessory adapter enables one of a compatible group of accessory holders to be attached to a selected position on a load-carrying system. Exchanging one accessory adapter for another may be desirable, for example, to replace a worn or damaged accessory holder or to carry an accessory holder selected to support a particular activity or task.

Figure 10:
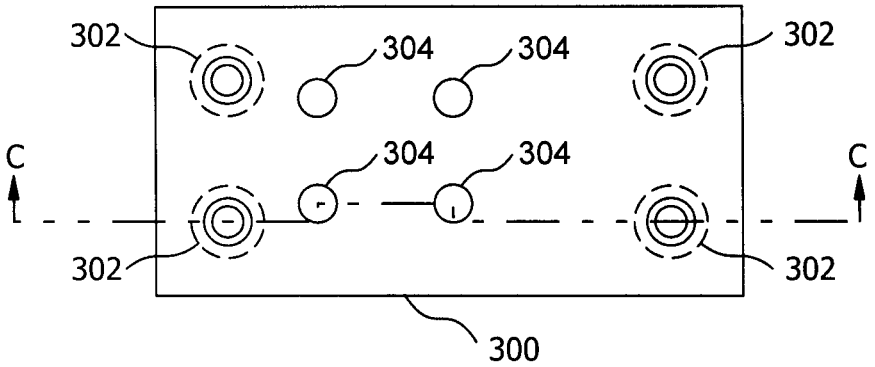
FIG. 10 is a front view of an example of an accessory adapter comprising captive fasteners for attachment of a reversible hanger and a plurality of holes for attachment of an accessory holder.
Figure 11:
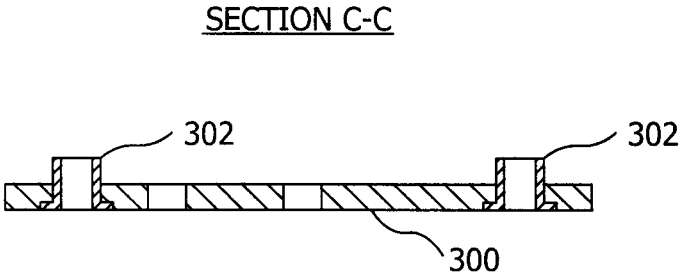
FIG. 11 is a cross-sectional view of the accessory adapter of FIG. 10. A location and viewing direction for the cross section is shown by a line marked C-C in FIG. 10.

An example of an accessory adapter is shown in FIG. 10 and FIG. 11. The accessory adapter 300 in FIG. 10 comprises a relatively stiff structural part, for example a metal plate, which includes a plurality of threaded inserts 302 for assembling a reversible hanger to the accessory adapter with threaded fasteners. In some embodiments, the accessory adapter includes a layer of fabric in contact with and extending beyond the edges of one side of the stiff structural part, thereby enabling the accessory adapter to be attached by stitching to an accessory holder. An accessory adapter may optionally comprise a plurality of layers, for example one or more layers comprising leather, synthetic leather, polymer foam, flexible plastic, webbing, fabric, or metal, or combinations of these materials.

The accessory adapter 300 of FIG. 10 and FIG. 11 further comprises a plurality of holes 304 for attaching an accessory holder to the accessory adapter. The holes 304 are sized for a clearance fit of a threaded fastener. Alternatively, threaded holes, snaps, threaded inserts, or other removable means of attachment are substituted for the clearance holes 304. A number, size, and location of the holes 304 are selected to align with corresponding mounting features on selected accessory holders. A number, size, and location of the threaded inserts 302 are selected to align with the corresponding holes in a reversible hanger, for example the holes 206 in FIGS. 7 and 8. The threaded inserts 302 may optionally protrude above a surface of the accessory adapter 300, as shown in FIG. 11, or may alternatively be flush with the surface of the accessory adapter.

Figure 2:
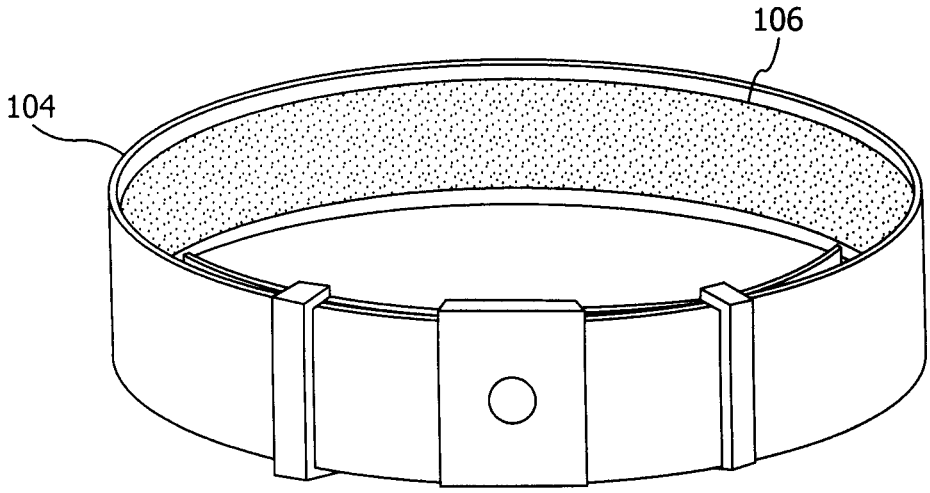
FIG. 2 is a pictorial view of an example of a load-carrying structure comprising a duty belt having a band of loop material on an inside surface of the belt. (PRIOR ART)
Figure 3:
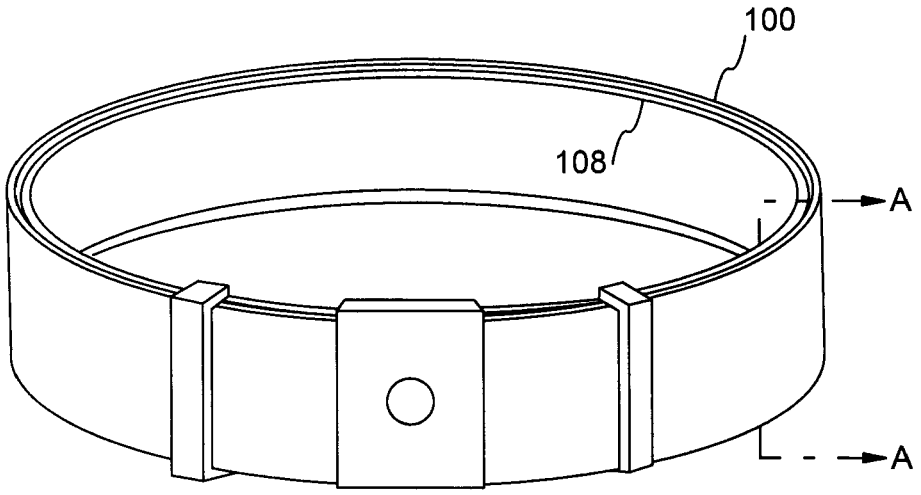
Fig. 3 PRIOR ART
FIG. 3 is a pictorial view of an example of a load-carrying structure comprising a duty belt and a liner belt. (PRIOR ART)
Figure 4:
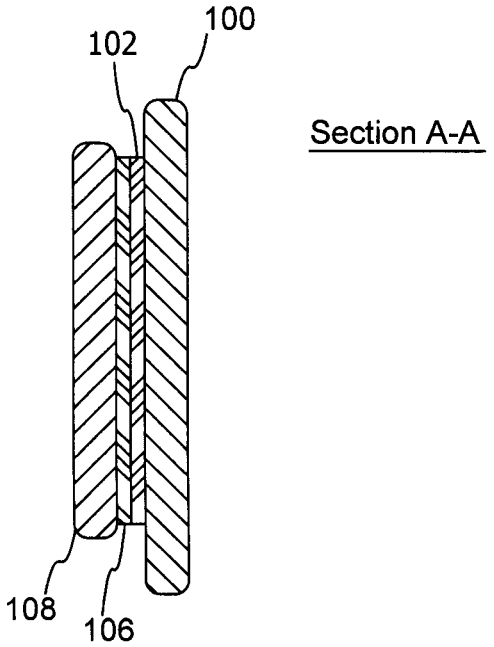
FIG. 4 is a cross-sectional view of the duty belt and liner belt of FIG. 3. A location and viewing direction for the cross section is shown by a line marked A-A in FIG. 3. (PRIOR ART)
Figure 5:
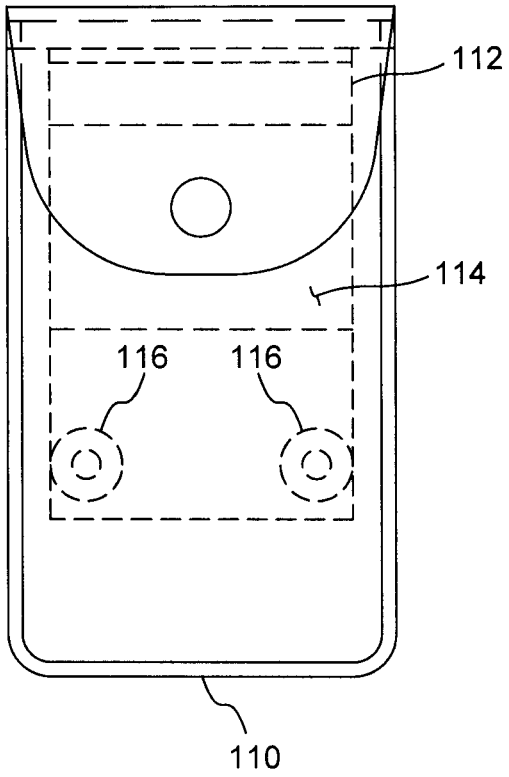
Fig. 5 PRIOR ART
FIG. 5 is a front view of an example of an accessory holder having one of the complementary parts of hook-and-loop fastener material on an inside surface of a belt loop for attachment to a load-carrying system having the other complementary part of hook-and-loop fastener material. (PRIOR ART)
Figure 6:
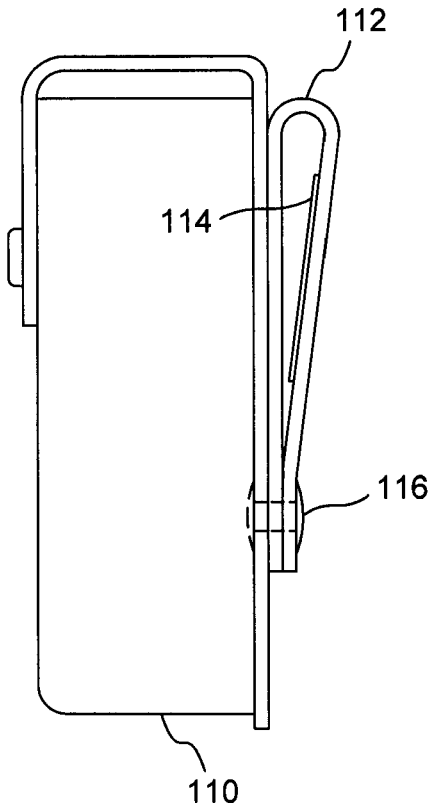
Fig. 6 PRIOR ART
FIG. 6 is a side view of the accessory holder of FIG. 5. (PRIOR ART)
Figure 12:
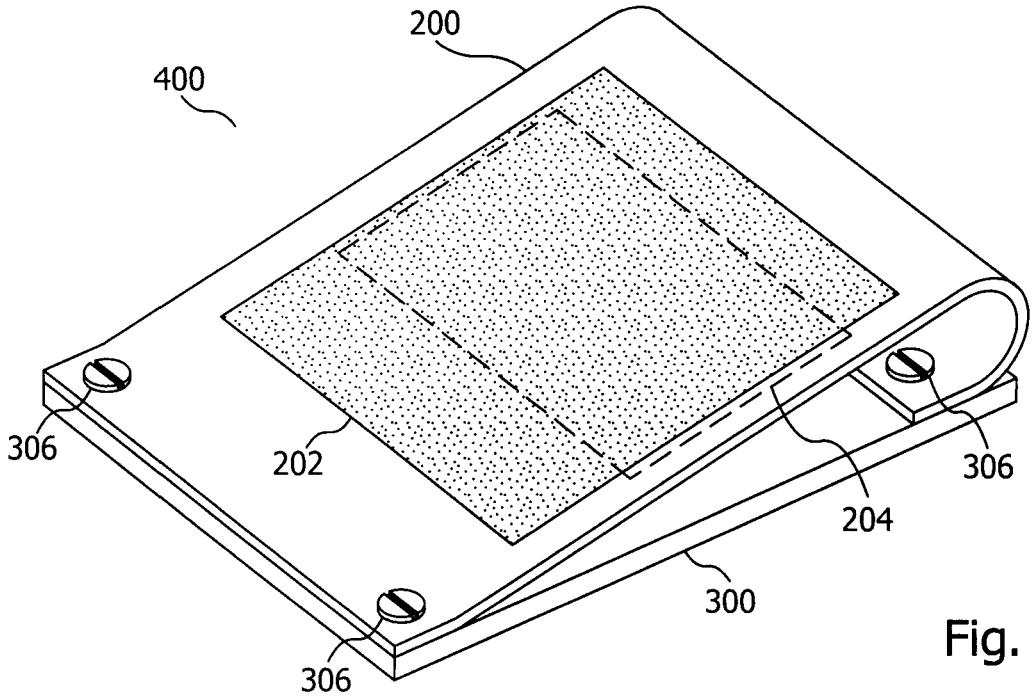
FIG. 12 is a pictorial view of an example of a reversible attachment device, showing one of several alternative assembly configurations of a reversible hanger and an optional accessory adapter.
Figure 13:
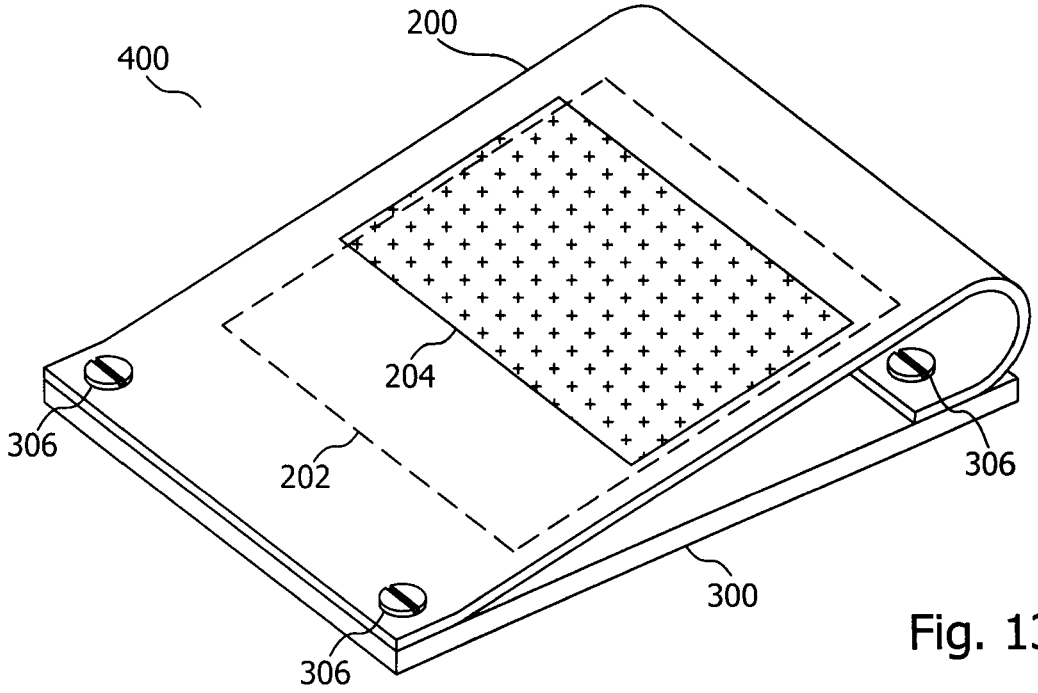
FIG. 13 illustrates the reversible attachment device of FIG. 12 with the reversible hanger in one of several alternative arrangements for attachment to a load-carrying structure comprising hook material.

FIGS. 12 and 13 show two of several alternative assembly configurations for a reversible hanger 200 and an accessory adapter 300. The reversible attachment device 400 comprises a reversible hanger 200 removably assembled to an accessory adapter 300 with a plurality of threaded fasteners 306. Alternatively, snaps, hook material, loop material, or other removable means of attachment may be substituted for the threaded fasteners 306. The reversible hanger 200 is assembled to the accessory adapter 300 with a bend through more than 180 degrees of arc near one end so as to create a gap between the reversible hanger 200 and the accessory adapter 300. A length for the reversible hanger 200 and a length for the accessory adapter 300 are selected to create a gap having a size large enough for a clearance fit of a selected load-carrying structure. For example, in one embodiment the reversible hanger 200 and the accessory adapter 300 have lengths selected to create a gap large enough for a duty belt as shown in FIG. 1. Other embodiments have lengths selected for a duty belt as shown in FIG. 2 or FIG. 3 or for straps in other load-carrying systems, such as straps comprising a PALS grid. One will appreciate that many different embodiments may be made with different lengths for the reversible hanger 200 and the accessory adapter 300.

In FIG. 12, the reversible hanger 200 is assembled to the accessory adapter 300 with the hook material 204 facing the accessory adapter 300. In FIG. 13, the reversible hanger 200 of FIG. 12 is assembled to the accessory adapter 300 with the loop material 202 facing the accessory adapter 300. Assembling the reversible hanger 200 to the accessory adapter 300 with the side having hook material 204 facing the accessory adapter 300 is preferred for attachment to a load-carrying structure having loop material, for example the duty belt illustrated in FIG. 2. Assembling the reversible hanger 200 to the accessory adapter 300 with the side having loop material 202 facing the accessory adapter 300 is preferred for attachment to a load-carrying structure having hook material, for example the duty belt illustrated in FIG. 1.

Figure 14:
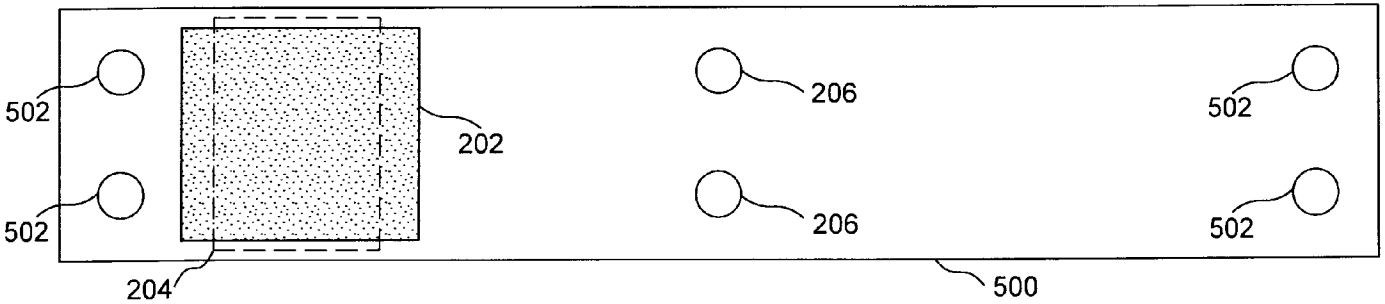
FIG. 14 is an example of a reversible hanger adapted to form a complete loop when the reversible hanger is folded.

Another example of a reversible hanger is shown in FIG. 14. The reversible hanger 500 of FIG. 14 is made from a flexible material so that the reversible hanger may be folded until the through holes 502 at one end align with the through holes 502 at the opposite end, thereby forming a complete loop. The aligned holes 502 and the centrally located holes 206 are sized for a clearance fit of fasteners used to attach the reversible hanger 500 to an accessory holder or an accessory adapter. As in other embodiments of a reversible hanger, the reversible hanger 500 of FIG. 14 includes a piece of loop material 202 on a first side and a piece of hook material 204 on a second side opposite the first side.

Figure 15:
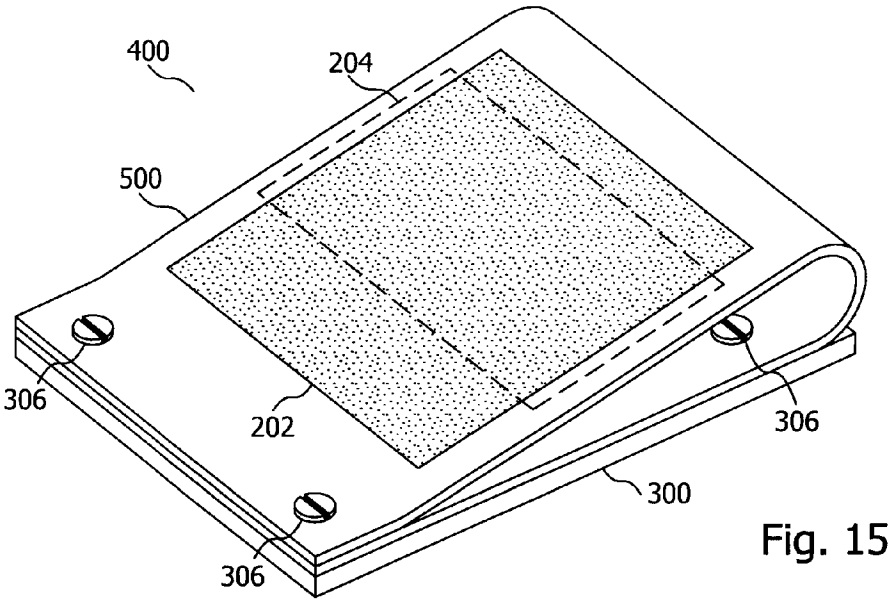
FIG. 15 is a pictorial view of the reversible hanger of FIG. 14 assembled to an accessory adapter.

An embodiment of a reversible attachment device comprising the reversible hanger of FIG. 14 and an accessory adapter is shown in FIG. 15. The reversible attachment device 400 of FIG. 15 comprises a reversible hanger 500 assembled to an accessory adapter 300 with a plurality of threaded fasteners 306. In the example of FIG. 15, the reversible hanger is folded into a loop through which a load-carrying structure may be passed. The complete loop formed by the reversible hanger 500 in FIG. 15 may be compared to the partial loop formed by the reversible hanger 200 in FIG. 12 and FIG. 13. The reversible hanger 500 of FIG. 14 may optionally be attached to an accessory holder without using an accessory adapter.

Figure 16:
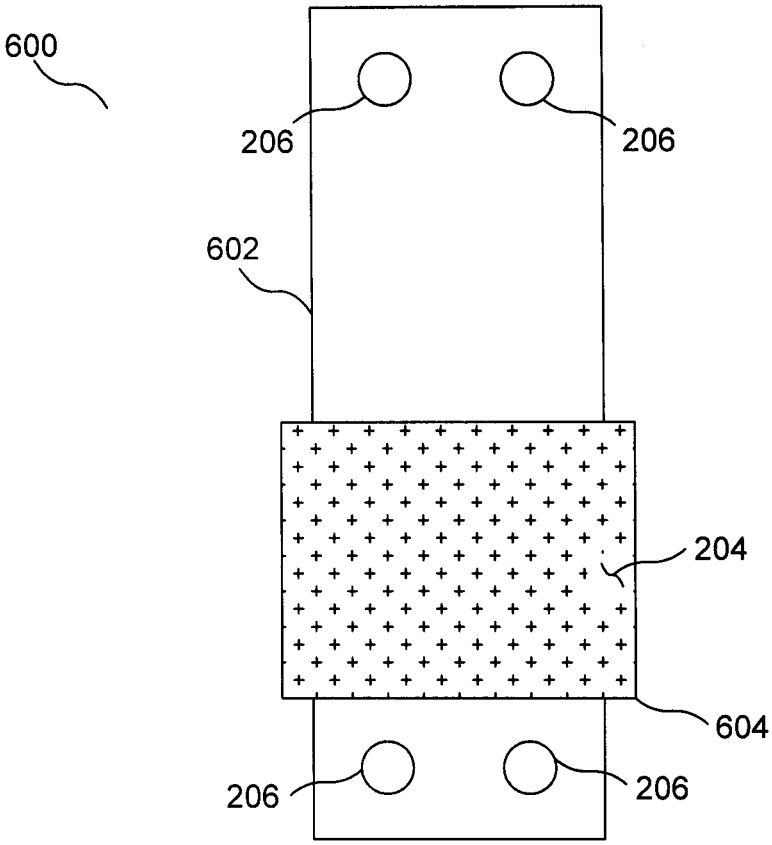
FIG. 16 is a front view of an embodiment of a reversible hanger comprising a flexible tab and a sleeve having hook material on a first side of the sleeve.
Figure 17:
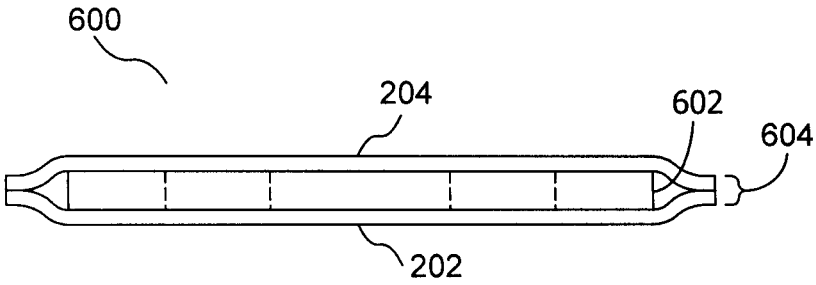
FIG. 17 is an end view of the reversible hanger embodiment of FIG. 16, showing hook material on the first side of the sleeve and loop material on a second side of the sleeve.

Yet another example of a reversible hanger is shown in FIG. 16 and FIG. 17. The reversible hanger 600 of FIG. 16 comprises a flexible tab 602 and a sleeve 604. An end view of the flexible tab 602 and the sleeve 604 are shown in FIG. 17. The sleeve 604 has a piece of hook material 204 with the hooks facing outward on a first side of the sleeve and a piece of loop material 202 with the loops facing outward on a second side of the sleeve. The sleeve 604 may optionally be formed from pieces of hook-and-loop material joined together along two edges, as in FIG. 17. Alternately, a sleeve 604 may comprise pieces of hook-and-loop material affixed to a substrate such as fabric or plastic. In some embodiments, the sleeve 604 fits slidably over the flexible tab 602, giving a degree of adjustability in adapting a reversible attachment device to a load-carrying structure. In other embodiments, the sleeve 604 is attached at a selected location to the flexible tab 602. The flexible tab 602 of FIG. 16 forms a partial loop when folded, similar to the partial loop formed by the reversible hanger 200 in FIG. 12 and FIG. 13. A flexible tab 602 may optionally be constructed to form a complete loop when folded, similar to the complete loop formed by the reversible hanger 500 in FIG. 14 and FIG. 15.

A size and location for a piece of hook-and-loop material attached to an embodiment of a reversible hanger are selected to position the hook-and-loop material so it will adhere to a complementary piece of hook-and-loop material on a load-carrying structure. Different embodiments of a reversible attachment device may have different sizes and locations of hook-and-loop material to enable connection to different load-carrying structures. Furthermore, a size and an adhesion strength per unit area of the hook-and-loop material are chosen to provide a selected amount of adhesion force between a reversible hanger and a load-carrying structure. Different amounts of adhesion force may be selected, for example, to retain equipment of different weights or to enable an accessory holder to be repositioned or removed easily, quietly, or quickly.

Figure 18:
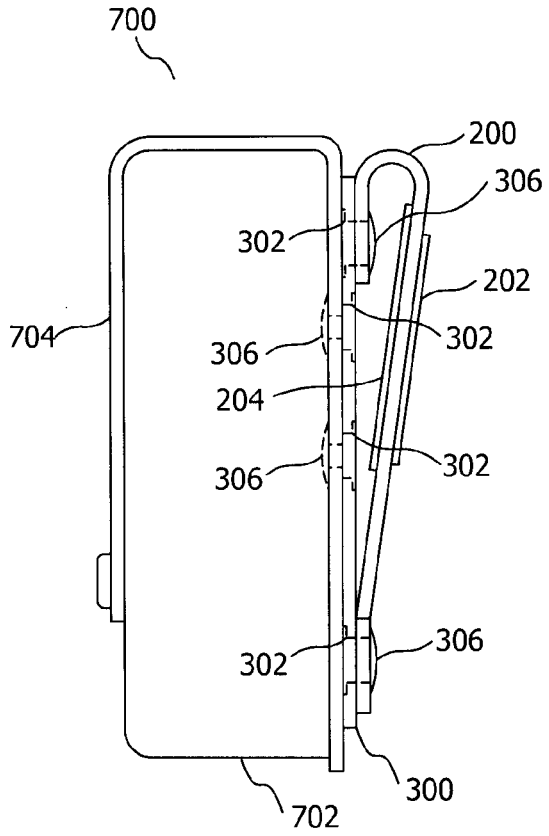
FIG. 18 is a side view of an embodiment of a reversible attachment device removably attached to an example of an accessory holder.
Figure 19:
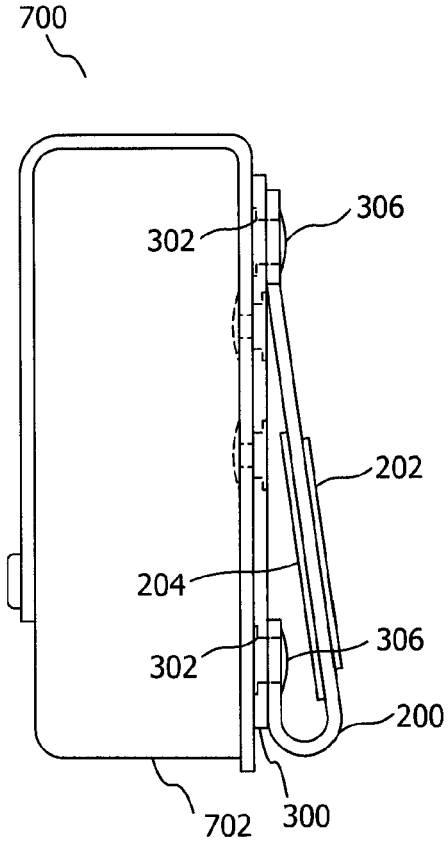
FIG. 19 is a side view of the embodiment of FIG. 18, showing an alternative attachment position for a reversible hanger on an accessory adapter.

A side view of a reversible attachment device comprising a reversible hanger and an accessory adapter combined with an accessory holder is shown in FIG. 18 and FIG. 19. FIG. 18 illustrates an example of an accessory holder 702 having a cover 704. The accessory holder 702 is removably assembled to an accessory adapter 300 with at least two threaded fasteners 306 passing through a back surface of the accessory holder 702 and into threaded inserts 302 in the accessory adapter 300. A reversible hanger 200 is assembled to the accessory holder 300 with at least two threaded fasteners 306 connecting the reversible hanger 200 to threaded inserts 302 in the accessory adapter 300. Alternately, a piece of fabric is placed over the accessory adapter 300 and the fabric is stitched to the accessory holder 702, thereby retaining the accessory adapter 300 against the accessory holder 200.

The reversible hanger 200 in FIG. 18 is assembled to the accessory adapter 300 with the side having hook material 204 facing the accessory adapter 300. The reversible attachment device in FIG. 18 is configured for attachment of the accessory holder 702 to a load-carrying structure comprising loop material. The reversible attachment device in FIG. 18 would be configured for attaching the accessory holder 702 to a load-carrying structure comprising hook material by reversing the reversible hanger 200 so that the side with loop material 202 faces the accessory adapter 300.

In the embodiment of FIG. 18, the reversible hanger 200 is assembled to the accessory holder 300 with a large bend in the reversible hanger 200 near a top side of the accessory holder 702. The large bend creates a gap between the accessory adapter 300 and the reversible hanger 200 through which a load-carrying structure, for example a duty belt or a strap in a PALS grid, may be passed. The reversible hanger 200 may optionally be attached to the accessory holder 300 with the large bend near a bottom side of the accessory holder 702, as shown in FIG. 19. Changing the location of the large bend correspondingly changes a position of the accessory holder 702 relative to a load-carrying structure. For example, the accessory holder 702 in FIG. 19 will be carried higher relative to a duty belt from which it is suspended compared to the accessory holder 702 in FIG. 18. In either of the configurations shown in FIG. 18 and FIG. 19, the reversible hanger 200 may optionally be attached to the accessory adapter 300 with either the hook material 204 or the loop material 202 facing the accessory adapter 300 in order to adapt the reversible attachment device to a particular load-carrying structure.

In the example of FIG. 18 and FIG. 19, the accessory holder 702 is removably assembled to the reversible attachment device comprising the accessory adapter 300 and the reversible hanger 200. The reversible attachment device of FIG. 18 is suitable for use with an accessory holder supplied with the reversible attachment device or for selected accessory holders supplied by a user of the reversible attachment device, that is, for retrofitting to selected accessory holders. In other embodiments, the threaded fasteners 306 and threaded inserts 302 for joining the accessory holder 702 to the accessory adapter 300 are replaced with fixed joining means, for example stitching, rivets, or adhesive.

Figure 20:
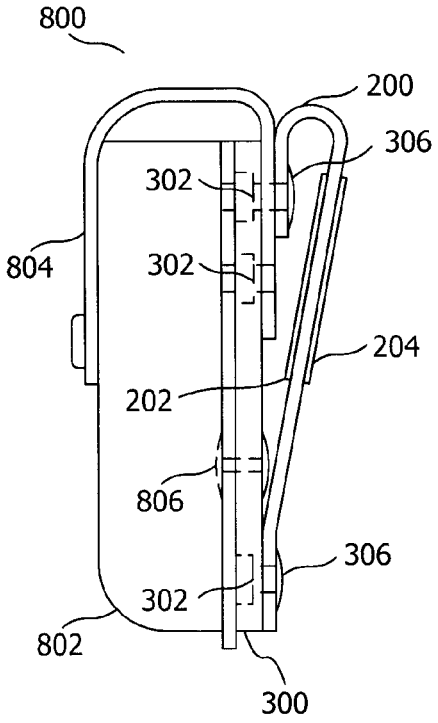
FIG. 20 is a side view of an example of an embodiment of the invention comprising a combination of an accessory holder, an accessory adapter that is part of the accessory holder, and a reversible hanger removably attached to the accessory adapter.

An embodiment of a reversible attachment device may optionally be a part of an accessory holder, as shown in the example of FIG. 20. FIG. 20 is a side view of an accessory holder 802 having an accessory adapter 300 as part of the back surface of the accessory holder. Other parts of the accessory holder 802 may be attached to an accessory adapter 300 that is part of the accessory holder, for example the cover 804. The cover 804 is attached to the accessory adapter 300 by stitching, rivets, or similar nonremovable attachment means. Alternately, the cover 804 may be attached to the accessory adapter 300 by threaded fasteners 806 to enable removal of the cover for replacement or attachment to the accessory adapter in a selected position. FIG. 20 shows a cover 804 removably attached to the body of the accessory holder 802 in one of several selectable positions, providing one or more choices in spacing between the cover 804 and the case of the accessory holder 802. As shown in FIG. 18, one or more threaded fasteners 306 pass through corresponding holes in the cover 804 and are retained by threaded inserts 302 in the accessory adapter 300.

Figure 21:
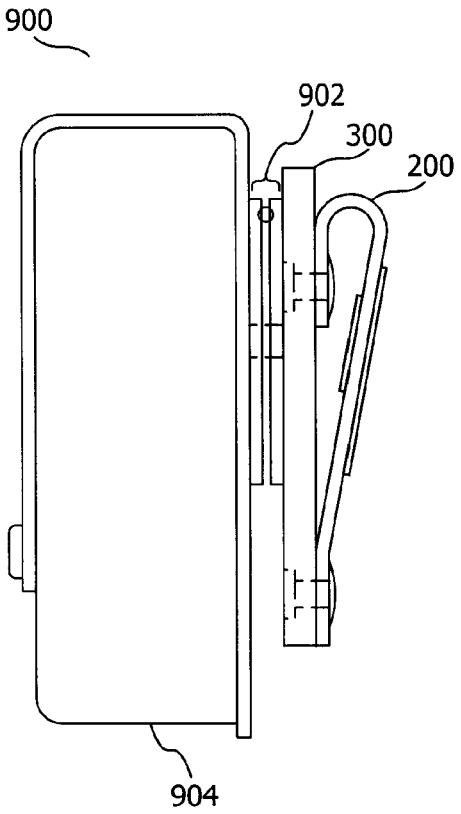
FIG. 21 is a side view of an embodiment having a rotator plate for rotationally coupling an accessory holder to an accessory adapter.

It is sometimes advantageous to be able to rotate an accessory holder relative to a load-carrying structure. The accessory holder may be rotated, for example, to put equipment in a more favorable position for access, to arrange a more comfortable position for equipment held close to a wearer's body, or to reduce the possibility of an accessory holder or the equipment it holds becoming entangled with or striking a foreign object. An example of a combination of an embodiment of a reversible attachment device comprising an accessory adapter and a reversible hanger and an accessory holder having a rotation feature is shown in FIG. 21. FIG. 21 shows a side view of a reversible attachment device comprising a reversible hanger 200 assembled to an accessory adapter 300 which includes a rotator plate 902. A rotator plate is a device having two mounting plates rotationally coupled through a hub or pivot. Two objects to be rotated relative to one another are attached to the mounting plates, one object to each plate. Some rotator plates have an indexing device that causes the rotator plate to stop rotation in one of a plurality of predetermined rest positions. The rotator plate 902 of FIG. 21 is shown with an indexing ball between the two mounting plates of the rotator plate 902. An accessory adapter 300 is attached to one of the mounting plates of the rotator plate 902 and an accessory holder 300 is attached to the other mounting plate. In the embodiment of FIG. 21, a relative angle between the accessory holder 904 and the accessory adapter 300 may be selected by pivoting the accessory holder 904 about the rotational axis of the rotator plate 902.

Figure 22:
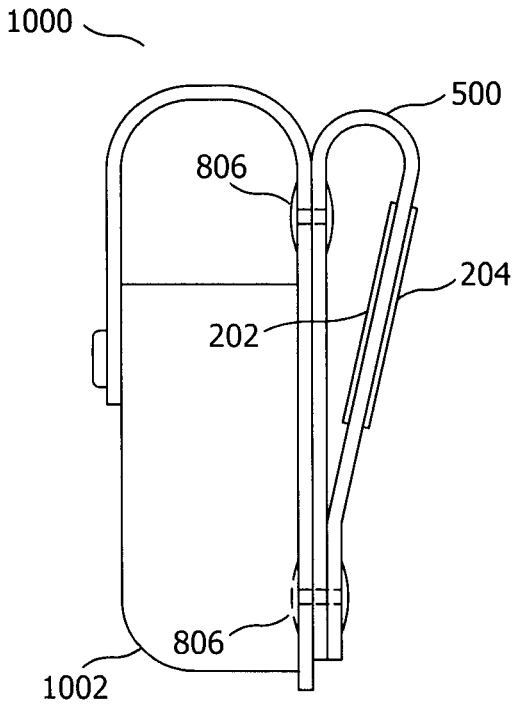
FIG. 22 is an example of an embodiment combining a reversible attachment device with an accessory holder. In the example of FIG. 22, the reversible attachment device does not include an optional accessory adapter.

In some embodiments, a reversible attachment device comprising a reversible hanger, but not including an accessory adapter, is attached to an accessory holder. For example, FIG. 22 illustrates an embodiment of a reversible attachment device 1000 comprising an accessory holder 1002 attached to a reversible hanger 500 with a plurality of threaded fasteners 806. The reversible hanger 500 may optionally be attached to the accessory holder 1002 with either the side having loop material 202 facing the back of the accessory holder 1002, as shown in FIG. 22, or the side having hook material 204 facing the back of the accessory holder. Furthermore, the reversible hanger 500 may optionally be attached to the accessory holder with the fold in the reversible hanger located near the top of the accessory holder, as shown in FIG. 22, or with reversible hanger turned around so the fold is near the bottom of the accessory holder, similar to the position shown for the reversible hanger 200 in FIG. 19.

Figure 23:
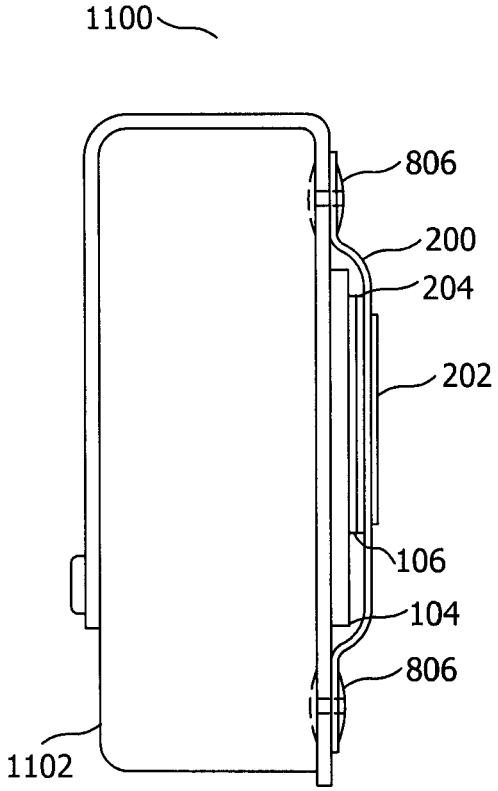
FIG. 23 is an example of an alternative assembly arrangement of a reversible attachment device and an accessory adapter.

A reversible hanger may optionally be attached to an accessory adapter or an accessory holder without bending the accessory hanger through a large angle. An example of a reversible hanger attached to an accessory holder without a large bend in the reversible hanger is shown in FIG. 23. In the example of FIG. 23, an embodiment of a reversible attachment device 1100 comprises a reversible hanger, for example the reversible hanger 200 of FIGS. 7-9, attached to an example of an accessory holder 1102 by a plurality of threaded fasteners 806. A separation distance between the upper and lower threaded fasteners 806 and a length of the reversible hanger 200 are selected to create a space between the reversible hanger 200 and the back of the accessory holder 1102. As shown in FIG. 23, a load-carrying structure such as a belt or strap may be passed through the space so formed, for example the duty belt 106 of FIG. 2 having loop material 106 on an inside surface of the duty belt. As in other embodiments of a reversible attachment device, the reversible hanger 200 may be attached to the accessory holder 1102 with either the side having hook material 204 facing the back of the accessory holder 1102, as shown in FIG. 23, or the side having loop material 202 facing the back of the accessory holder, thereby accommodating load-carrying structures having either hook material or loop material.

In FIGS. 18-22, any one of reversible hangers 200, 500, or 600 may be substituted for the reversible hanger shown in the figure. Also, the reversible hanger in each of FIGS. 18-22 may be positioned with the large bend in the reversible hanger near the top side of the accessory holder or near the bottom side of the accessory holder, as in the examples of FIG. 18 and FIG. 19. Furthermore, the reversible hanger in FIGS. 18-23 may be positioned with either the side having loop material facing the back of the accessory holder or the side having hook material facing the back of the accessory holder. Also, one will appreciate that the examples of accessory holders shown in FIGS. 18-23 are intended to represent many alternative accessory holders that could be used with or optionally be included as part of an embodiment of a reversible attachment device. Some embodiments further include a load-carrying structure, for example but not limited to, a duty belt, a duty belt and a liner belt, a chest sling, or a backpack having a PALS grid.

The present disclosure is to be taken as illustrative rather than as limiting the scope, nature, or spirit of the subject matter claimed below. Numerous modifications and variations will become apparent to those skilled in the art after studying the disclosure, including use of equivalent functional and/or structural substitutes for elements described herein, use of equivalent functional couplings for couplings described herein, or use of equivalent functional steps for steps described herein. Such insubstantial variations are to be considered within the scope of what is contemplated here. Moreover, if plural examples are given for specific means, or steps, and extrapolation between or beyond such given examples is obvious in view of the present disclosure, then the disclosure is to be deemed as effectively disclosing and thus covering at least such extrapolations.

Unless expressly stated otherwise herein, ordinary terms have their corresponding ordinary meanings within the respective contexts of their presentations, and ordinary terms of art have their corresponding regular meanings.

What is claimed is:

1. A device for removably attaching an accessory holder to a load-carrying structure, comprising: an accessory holder having a front side adapted for holding an accessory and a back side opposite said front side; and a reversible attachment device comprising: a reversible hanger having a first side and a second side parallel to said first side, a first end and a second end, wherein the first end of the reversible hanger is detached from the second end of the reversible hangar; a piece of hook material of a hook-and-loop fastener on said first side of said reversible hanger; and a piece of loop material of a hook-and-loop fastener on said second side of said reversible hanger; said reversible attachment device having a first attachment position in which said reversible hanger is attached to said accessory holder to form a belt loop sized for a clearance fit around the load-carrying structure, folded so both of said first and second sides of said reversible hanger are in contact with said back side of said accessory holder, with both of said first end and second end of said reversible hanger in contact with said back side of said accessory holder, with said second side of said reversible hanger having said piece of loop material of a hook-and-loop fastener is located on an inside of said belt loop formed by said reversible hanger and said second side of said reversible hanger having said piece of hook material of a hook-and-loop fastener is located on an outside of said belt loop formed by said reversible hanger and wherein said piece of loop material located on the inside of said belt loop is in contact with a piece of hook material on a load-carrying structure; and said reversible attachment device having a second attachment position in which said reversible hanger is attached to said accessory holder to form a belt loop sized for a clearance fit around the load-carrying structure, folded so both of said first and second sides of said reversible hanger are in contact with said back side of said accessory holder, with said first side of said reversible hanger having said piece of hook material of a hook-and-loop fastener is located on the inside of said belt loop formed by said reversible hanger and said second side of said reversible hanger having said piece of loop material of a hook-and-loop fastener is located on the outside of said belt loop formed by said reversible hanger and wherein said hook piece of material located on the inside of said belt loop is in contact with a piece of loop material on said load-carrying structure.

2. The device for removably attaching an accessory holder to a load-carrying structure of claim 1, wherein said reversible hanger is formed with a plurality of through-holes sized for a clearance fit of a selected threaded fastener and said reversible attachment device is removably attachable to said accessory holder.

3. The device for removably attaching an accessory holder to a load-carrying structure of claim 1, wherein said first piece of hook-and-loop material and said second piece of hook-and-loop material are permanently attached to said reversible hanger.

4. The device for removably attaching an accessory holder to a load-carrying structure of claim 1, wherein said first piece of hook-and-loop material and said second piece of hook-and-loop material are formed into a sleeve which fits around said reversible hanger.

5. The device for removably attaching an accessory holder to a load-carrying structure of claim 4, wherein said sleeve fits slidably around said reversible hanger.

6. The device for removably attaching an accessory holder to a load-carrying structure of claim 1, further comprising a fold of greater than 180 degrees of arc near an end of the reversible hanger, wherein the reversible hanger may optionally be attached to the accessory holder with the fold either near a top side of the accessory holder or near a bottom side of the accessory holder, thereby adjusting a vertical position of the accessory holder relative to the load-carrying structure.

7. The device for removably attaching an accessory holder to a load-carrying structure of claim 6, wherein said reversible hanger is adapted to form a partial loop when folded for attachment to the accessory holder.

8. The device for removably attaching an accessory holder to a load-carrying structure of claim 6, wherein said reversible hanger is adapted to form a complete loop when folded for attachment to an accessory holder.

9. The device for removably attaching an accessory holder to a load-carrying structure of claim 1, wherein said reversible attachment device further comprises an accessory adapter removably attachable to said reversible hanger.

10. The device for removably attaching an accessory holder to a load-carrying structure of claim 9, wherein said accessory adapter further comprises a first side and a second side, said accessory adapter is adapted for removable attachment of said reversible hanger to said first side of said accessory adapter, and said second side of said accessory adapter is adapted for attachment of the accessory holder.

11. The device for removably attaching an accessory holder to a load-carrying structure of claim 10, wherein the accessory holder is removably attachable to said accessory adapter.

12. The device for removably attaching an accessory holder to a load-carrying structure of claim 10, wherein a length dimension of said reversible hanger and a length dimension of said accessory adapter are selected to create between said reversible hanger and said accessory adapter a space large enough for a clearance fit of a duty belt.

13. The device for removably attaching an accessory holder to a load-carrying structure of claim 10, further comprising a rotator plate attached to said second side of said accessory adapter.

14. The device for removably attaching an accessory holder to a load-carrying structure of claim 13, further comprising an accessory holder attached to said rotator plate.

15. The device for removably attaching an accessory holder to a load-carrying structure of claim 1, wherein said accessory holder is a holster.

16. The device for removably attaching an accessory holder to a load-carrying structure of claim 1, wherein said accessory holder is a case for handcuffs.

17. The device for removably attaching an accessory holder to a load-carrying structure of claim 2, further comprising the load-carrying structure.

18. The device for removably attaching an accessory holder to a load-carrying structure of claim 17, wherein the load-carrying structure is a duty belt having one of the complementary parts of hook-and-loop material on an inside surface of said duty belt.

19. A device for removably attaching an accessory to a load-carrying structure, comprising: an accessory adapter having a front side adapted for attachment of an accessory holder and a back side opposite said front side; and a reversible attachment device comprising: a reversible hanger having a first side and a second side parallel to said first side, a first end and a second end, wherein the first end of the reversible hanger is detached from the second end of the reversible hangar; a piece of hook material of a hook-and-loop fastener on said first side of said reversible hanger; and a piece of loop material of a hook-and-loop fastener on said second side of said reversible hanger; said reversible attachment device having a first attachment position in which said reversible hanger is attached to said accessory holder to form a belt loop sized for a clearance fit around the load-carrying structure, folded so both of said first and second sides of said reversible hanger are in contact with said back side of said accessory holder, with both of said first end and second end of said reversible hanger in contact with said back side of said accessory holder, with said piece of loop material of a hook-and-loop fastener located on an inside of said belt loop and said piece of hook material of a hook-and-loop fastener located on an outside of said belt loop and wherein said piece of loop material located on the inside of said belt loop is in contact with a piece of hook material on a load-carrying structure, and said reversible attachment device having a second attachment position in which said reversible hanger is attached to said accessory holder to form a belt loop sized for a clearance fit around the load-carrying structure, folded so both of said first and second sides of said reversible hanger are in contact with said back side of said accessory holder, with said piece of hook material of a hook-and-loop fastener located on the inside of said belt loop and said piece of loop material of a hook-and-loop fastener located on the outside of said belt loop and wherein said hook piece of material located on the inside of said belt loop is in contact with a piece of loop material on said load-carrying structure.

* * * * *